US005582318A

United States Patent [19]

Dietrich

[11] Patent Number: 5,582,318

[45] Date of Patent: Dec. 10, 1996

[54] BUNG RECEPTACLE

[75] Inventor: Klaus Dietrich, Mittelrot, Germany

[73] Assignee: Fraunhofer-Gesellschaft zur Forderung de angewandten Forderung e.V., Germany

[21] Appl. No.: 308,632

[22] Filed: Sep. 19, 1994

Related U.S. Application Data

[63] Continuation of Ser. No. 200,368, Feb. 23, 1994, abandoned, which is a continuation of Ser. No. 848,953, filed as PCT/DE90/00796 Oct. 21, 1990, abandoned.

[30] Foreign Application Priority Data

Oct. 22, 1989 [DE] Germany ..... 39 35 177.7

[51] Int. Cl.[6] ..... B65D 39/02

[52] U.S. Cl. ..... 220/319; 220/601

[58] Field of Search ..... 220/319, 601; 215/274

[56] References Cited

U.S. PATENT DOCUMENTS

| | | | |
|---|---|---|---|
| 1,673,010 | 6/1928 | Mauser | 220/319 |
| 2,337,456 | 12/1943 | Draper | 220/256 |
| 2,844,276 | 7/1958 | Dimmock | 220/319 |
| 3,291,362 | 12/1966 | Sproull et al. | 220/319 |
| 3,443,735 | 5/1969 | Meijers | 220/319 X |
| 3,790,020 | 2/1974 | Fine | 220/319 |

FOREIGN PATENT DOCUMENTS

| | | | |
|---|---|---|---|
| 336749 | 4/1959 | Switzerland | 220/319 |
| 366780 | 2/1932 | United Kingdom | 220/319 |

*Primary Examiner*—Stephen P. Garbe
*Attorney, Agent, or Firm*—Evenson, McKeown, Edwards & Lenahan, P.L.L.C.

[57] ABSTRACT

A receptacle is disclosed which has a bunghole surrounded by a collar molded out of material of the receptacle to form a collar ceiling area. A closure arrangement for closing the bunghole is provided which includes a bung stop forming a bung stopper ceiling area, the bung stopper being disk-shaped and without any pretightening elements. A ceiling element is disposed in use between the collar ceiling area and the bung stopper ceiling area. A tightening element separate from the bung stopper engages with a counter element at the collar and is engageable with the bung stopper to compress the ceiling element in a direction of the collar area to sealingly close the bunghole.

11 Claims, 6 Drawing Sheets

BUNG RECEPTACLE

This application is a continuation of application Ser. No. 08/200,368, filed on Feb. 23, 1994, abandoned which is a continuation of application Ser. No. 07/848,953, filed as PCT/DE90/00796 Oct. 21, 1990 abandoned.

BACKGROUND AND SUMMARY OF THE INVENTION

The present invention relates to a bung receptacle having at least one bunghole which can be closed fluid-tight by means of a bung stopper.

Bung receptacles and especially bung receptacles made of steel are packaging means for fluid or even solid pourable fill goods and are, by way of illustration, set forth in DIN 6643. With regard to all details not made more apparent herein reference is made to this German Industrial Norm.

By way of definition, bung receptacles have an opening which is smaller than the inner diameter of the receptacle. This opening serves to fill, empty and ventilate the receptacle. This opening can usually be closed by a safety covering means.

For this purpose the bung receptacle usually has a so called "tri-sure flange" and a corresponding stopper. With regard to the design of this flange and the corresponding stopper reference is made to DIN 6643, Teil 2 (Section 2).

The tri-sure flange and the actual receptacle are manufactured separately as independent parts. Fitting a flange into a receptacle is carried out by means of a pressure forging procedure in the course of which a sealing means suited for the fill goods has to be fitted between the receptacle wall and the flange (cf. DIN 6643, Teil 2, V1) Sicherheitsverschluß (safety-lock).

This known safety flange has a number of disadvantages due to its design:

First, manufacture is costly and time consuming as the flange and the receptacle have to be fabricated separately. Secondly, flange pressure resistance is relatively low due to the pressure forging procedure.

Apart from the costly, time-consuming manufacturing process and the low internal pressure resistancy, the trisure flange has the additional drawback that deformation resistancy is low. Moreover, blockage of leakage of hygroscopic goods is low; furthermore, as there is no homogeneous transition of material, a sealing means suited for the fill goods is required. Finally, receptacles with such flanges cannot be completely emptied.

The so-called laser flange, which does not have the abovedescribed drawbacks as the flange element is welded to the wall of the receptacle by means of laser welding has, therefore, been developed by the firm BÜCO B üdenbender. This flange, however, has the disadvantage that its fabrication is extraordinarily expensive.

An object of the present invention is to improve a bung receptacle having at least one bunghole which can be closed fluid-tight by means of a bung stopper in such a manner that the actual bung flange or collar is easy and inexpensive to manufacture without detriment to the ability of closing the receptacle tightly.

This and other objects are achieved by the present invention which provides a bung receptacle having at least one bunghole, which can be closed fluid-tight by a bung stopper. The bunghole is surrounded by a collar molded out of the material of the receptacle. The collar is provided with a sealing area, being able to insert a sealing element between the sealing area and the bung stopper. At the collar and at the bung stopper a rim is disposed which, in order to close the bung receptacle, is embraced by a tightening element which biases the bung stopper in the direction of the sealing area provided on the collar.

In accordance with the present invention the bunghole is surrounded by a collar molded out of the material of the receptacle. This collar is provided with a sealing area. Between the sealing area and the bung stopper a sealing element can be fitted in order to seal the bunghole. No expensive or complicated manufacturing procedures are required for fabricating the actual collar since the collar is molded out of the receptacle wall by means of simple molding procedures.

In order to further reduce costs, the stopper, the bung stopper for the bunghole, is designed as simply as possible. For this purpose the collar and the stopper are each provided with a shoulder. In order to cover the bung receptacle these shoulders are enclosed by at least one tightening element which biases the bung stopper in the direction of the sealing area provided on the collar.

In another embodiment, the stopper, or the bung stopper, is preferably a simple disk. An attachment area is provided at the collar with which a tightening element can be made to engage which in order to close the receptacle tightens the bung stopper, or the stopper, i.e. the disk, in the direction of the sealing area provided on the collar.

By means of these measures it is possible to design bung receptacles in metal or plastic in such a manner that it is not only possible to fabricate the bung-shaped opening, but also to close it tightly with a cost-favorable stopper.

In this case, a rip-line is provided to the tightening element along which the tightening element can be ripped open for its removal. With this design an especially simple and cost-favorable tightening element is created.

In another embodiment, only one tightening element is provided which completely surrounds the bunghole. However, it is expressly pointed out that, several, by way of illustration, three tightening elements may be provided with an angular spacing of, by way of illustration, 120°.

In any event, the tightening element/elements may also be fitted radially or axially. The tightening elements may be attached by folding, flanging or extruding. The collar may also protrude outward or inward.

The attachment area in certain embodiments may be, by way of illustration, a bayonet flange or a thread. The tightening element is then accordingly a bayonet ring or a thread ring.

The thread at the collar may be an inward thread or a outward thread.

In all the embodiments, the sealing element may be selected depending on the goods the pour-receptacle is to contain. By way of illustration, the sealing element may be an O-ring made of materials known for this purpose.

Furthermore, it is preferable if, for the protection of the bung stopper, a rim, the height of which is greater than the collar, moulded out of the receptacle material surrounds it. The protection of the bung element with the bung stopper can be further improved in certain embodiments by providing it with a support ring and/or by turning the collar inward or outward by turning the collar in a sort of "S" shape both inward and outward thereby yielding a double wall. The double wall, in particular, has the advantage of better absorption of knocks and shocks to the bung joint.

Other objects, advantages and novel features of the present invention will become apparent from the following detailed description of the invention when considered in conjunction with the accompanying drawings.

DETAILED DESCRIPTION OF THE DRAWINGS

Figure 1:
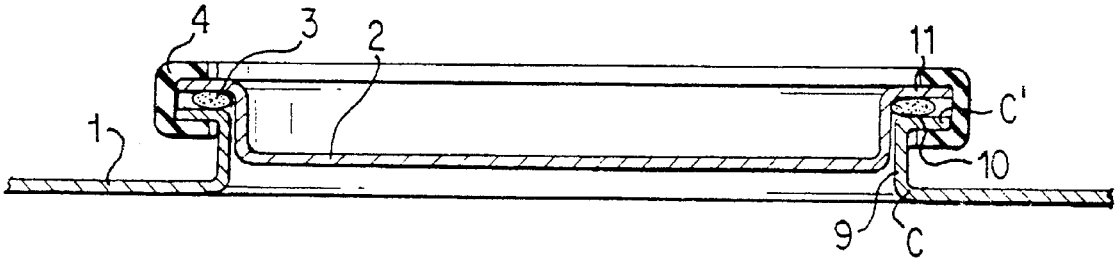
FIGS. 1 to 25 illustrate in cross-section a bung receptacle having a stopper constructed in accordance with various embodiments of the present invention.

In the following preferred embodiments, only a section of the bung receptacle is depicted, that of the receptacle wall 1 in the region of the bunghole. Furthermore, in the succeedingly described preferred embodiments the stopper is consistently numbered 2 and the fitted sealing means 3.

In the following, preferred embodiments with a tightening element in the form of a clamp band 4, 5 which surrounds the stopper 2 as well as the collar 9 at bung receptacle 1 are described with reference to FIGS. 1 to 15.

FIG. 1 shows a first preferred embodiment, in which the stopper 2 provided with the sealing element 3 is mounted on the collar 9 of the receptacle wall 1. The collar 9 extends between points C and C'. The sealing element 3 is disposed between a collar sealing area 10 of the collar 9 and a stopper sealing area 11 of the stopper 2. The clamp band 4 is attached with a suitable device in situ, e.g. by folding, flanging or extrusion, etc.. In order to tighten the collar-stopper joint, the stopper 2 is pressed toward the collar 9 during application of the clamp band, compressing the sealing element 3 between the collar sealing area 10 and the stopper sealing area 11. Opening the collar-stopper connection can ensue by removing the clamp band by means of a rip-line.

Figure 2:
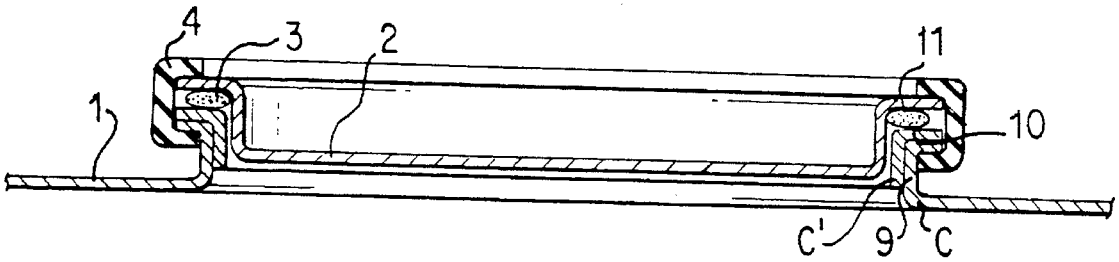

The second preferred embodiment illustrated in FIG. 2 largely corresponds to the first preferred embodiment, however, the receptacle 1 has a double-walled collar to increase the sturdiness and firmness of the collar.

Figure 3:
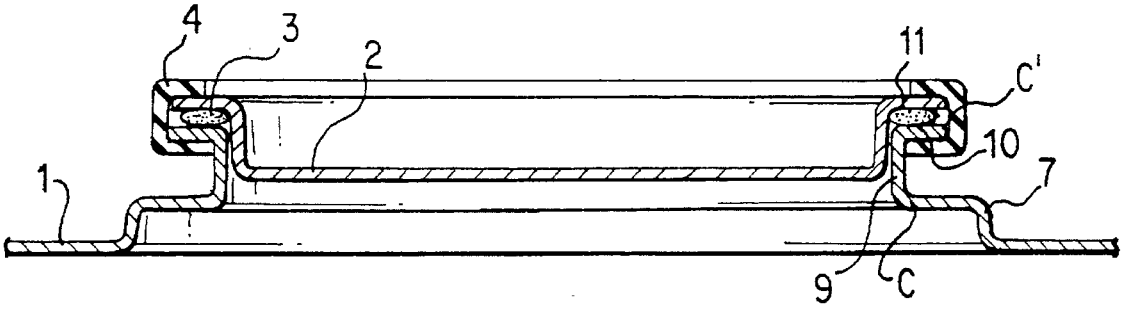

The third preferred embodiment illustrated in FIG. 3 is also designed like the first preferred embodiment, however, the receptacle wall 1 has a rim 7 surrounding the collar 9 which also contributes to increasing firmness and sturdiness.

Figure 4:
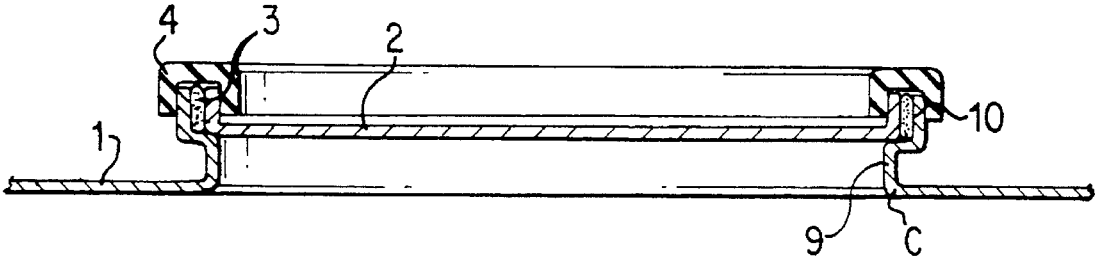

The fourth preferred embodiment illustrated in FIG. 4 differs from the previous embodiments in that the sealing surface at the receptacle wall 1 and the bung stopper 2 is not disposed in parallel to the receptacle wall, but rather vertically thereto. Accordingly the clamp band 4 is not mounted radially like in the previous preferred embodiments, but rather axially.

Figure 5:
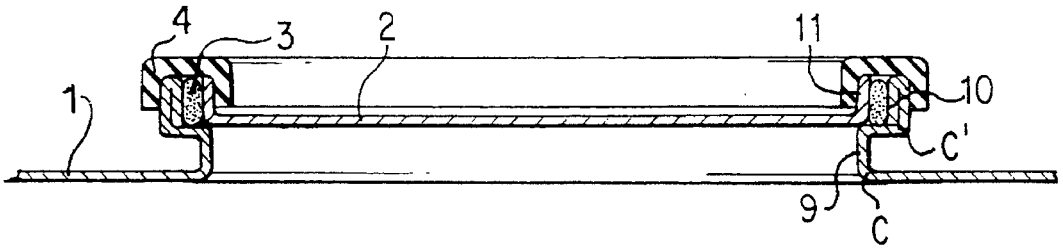

The fifth preferred embodiment illustrated in FIG. 5 largely corresponds to the fourth preferred embodiment, however, the wall of receptacle 1 is doubled in order to increase the sturdiness and firmness.

Figure 6:
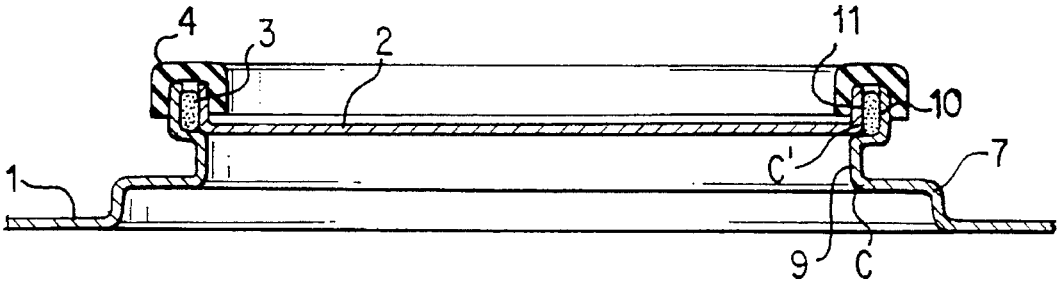

The sixth preferred embodiment illustrated in FIG. 6 differs from the fourth preferred embodiment in that a rim 7 surrounds the collar 9, which also contributes to the sturdiness and firmness of the collar.

Figure 7:
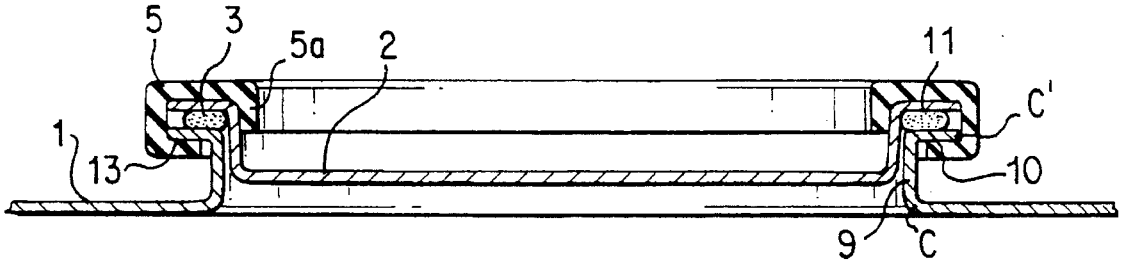

The seventh preferred embodiment illustrated in FIG. 7 is provided with a clamp band 5. The clamp band 5 is similar to the clamp band 4 shown in FIGS. 1-3, but further comprises an additional portion 5*a* which extends in an axial direction on a radially inward side of the stopper 2. The clamp band 5 embraces both the stopper 2 and a corresponding attachment area 13 of the collar. Here again a sealing element 3 is fitted between stopper 2 and the collar 9. The stopper 2 is pressed toward the collar at the receptacle 1 by the clamp band 5, compressing the sealing element 3 between the collar sealing area 10 and the stopper sealing area 11. In this case the clamp band is a snap closing means and can be applied by means of a tool which deforms the clamp band in the elastic range to such a degree that it can be attached. Loosening the clamp band 5 may, for example, ensue by means of a notch, into which a pulling-off tool can engage, provided in the circumference of the clamp band.

Figure 8:
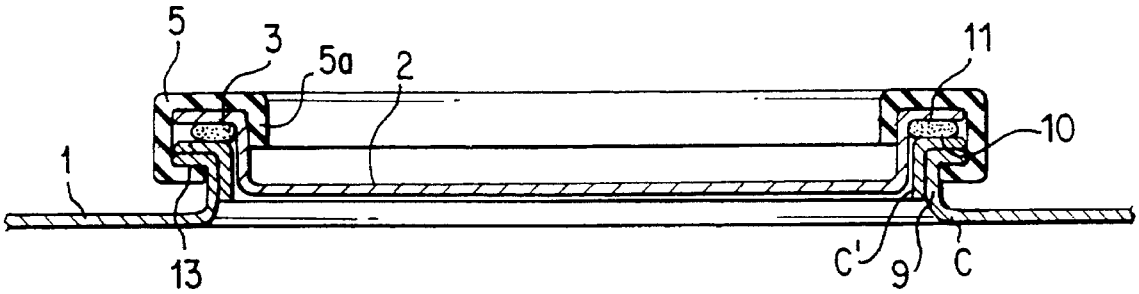

The eighth preferred embodiment illustrated in FIG. 8 differs from the seventh preferred embodiment in that, also in order to improve the sturdiness and firmness of the collar, the receptacle wall 1 in the collar is doubled.

Figure 9:
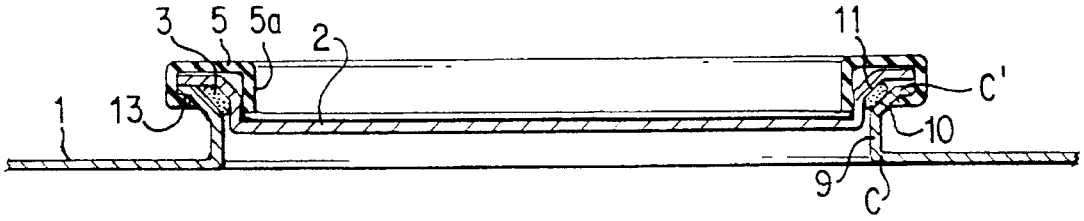
Figure 10:
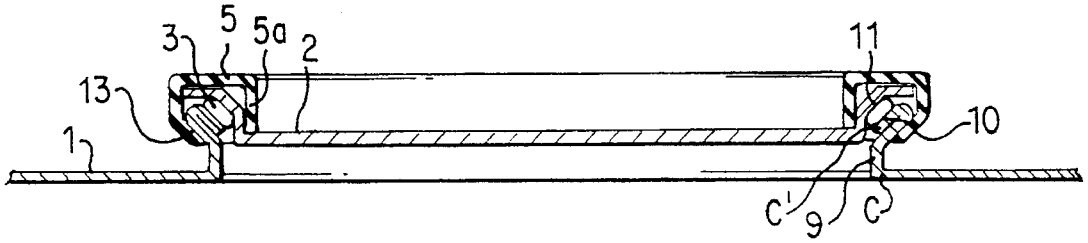

FIGS. 9 to 12 depict preferred embodiments which differ from the preferred embodiments illustrated in FIGS. 7 and 8 in the position of the sealing area. In FIGS. 9 and 10 the sealing (or gasket) area is disposed at an angle of between 0° and 90° to the receptacle wall 1, with the wall being a single wall (FIG. 9) and a double wall (FIG. 10), respectively.

Figure 11:
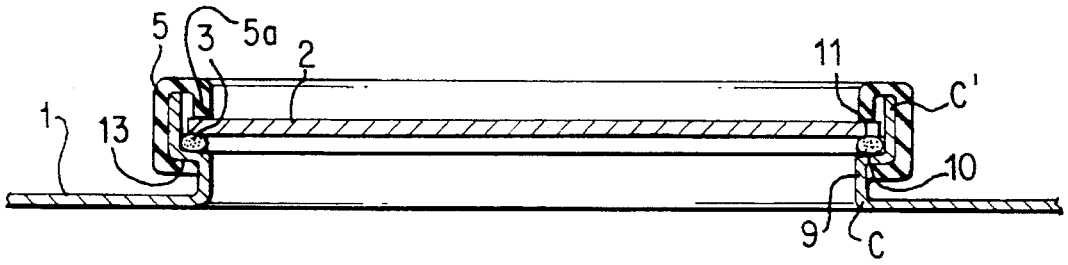
Figure 12:
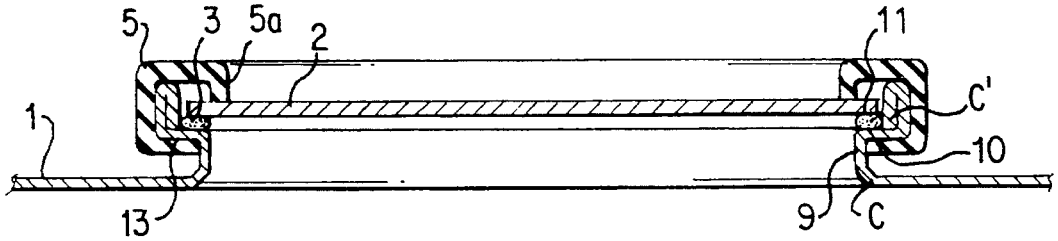

In the preferred embodiments illustrated in FIGS. 11 and 12 the collar molded out of the receptacle wall 1 in a sort of "S" shape is provided with a step whose horizontal section forms the collar sealing area 10 for the sealing means 3. Here once more a clamp band 5, which can be applied and loosened in the afore-described manner, is provided as the tightening element.

Preferred embodiments 11 and 12 differ from each other in that in preferred embodiment 12 the collar wall is double and in preferred embodiment 11 it is only a single wall.

Due to the horizontal arrangement of the sealing surfaces, a simple disk can be utilized as "bung stopper" 2 in both preferred embodiments.

Figure 13:
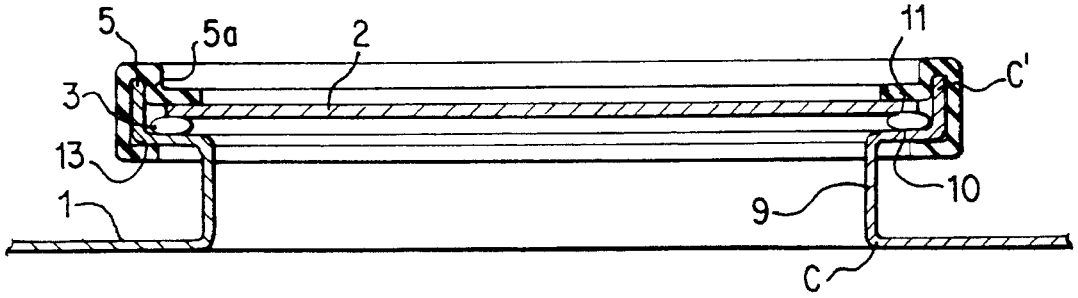

FIG. 13 depicts a further preferred embodiment which differs from the preferred embodiment in FIG. 11 essentially in the shape of the clamp band. In the former preferred embodiment the clamp band is designed in such a manner that it embraces the collar molded out of the receptacle wall 1 "tightly" thus ensuring a particularly secure fit.

Figure 14:
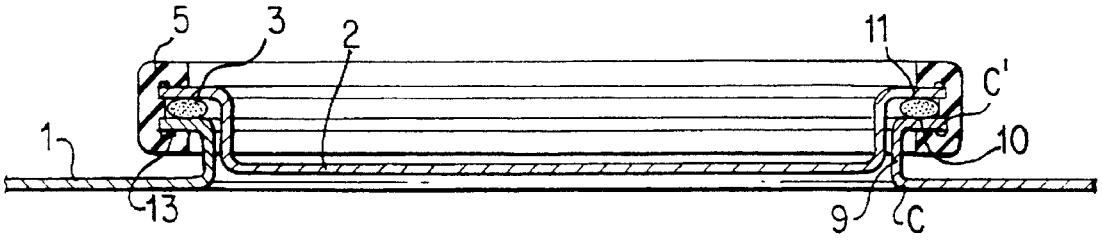

FIG. 14 depicts a preferred embodiment in which again the collar has a horizontal sealing area for the sealing means 3. In contrast to the preferred embodiments according to FIGS. 11 to 13, however, the bunghole 2 is not a simple disk, but rather has at the edge a flange edge which is engaged by the clamp band. In this way the design of the collar can be simplified.

Figure 15:
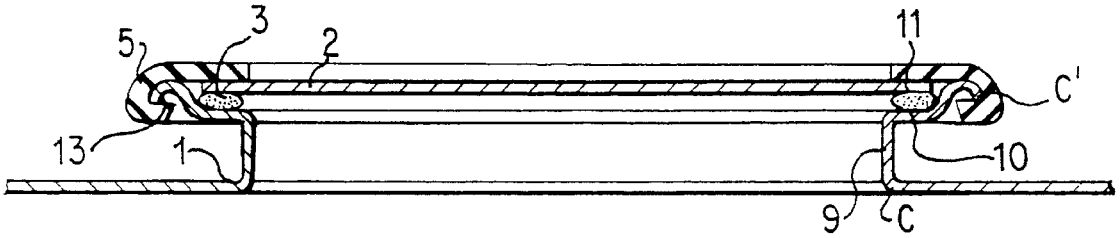

The preferred embodiment illustrated in FIG. 15 differs from the previous preferred embodiments in that the collar molded out of the receptacle wall is shaped in such a manner that a defined snap edge for the clamp band is yielded. In this preferred embodiment, a simple disk can be utilized as the bung stopper.

In the following section, preferred embodiments in which the bung stopper 2 is biased in the direction of the collar sealing area 10 by means of a thread ring 6 as the tightening element are described with reference to FIGS. 16 to 25. Here too 1 stands for the receptacle wall out of which a collar is molded by means of a reshaping procedure and 3 stands for the sealing element which is selected in accordance to the goods the bung receptacle is to contain and which, by way of illustration, may be an O-ring.

Figure 16:
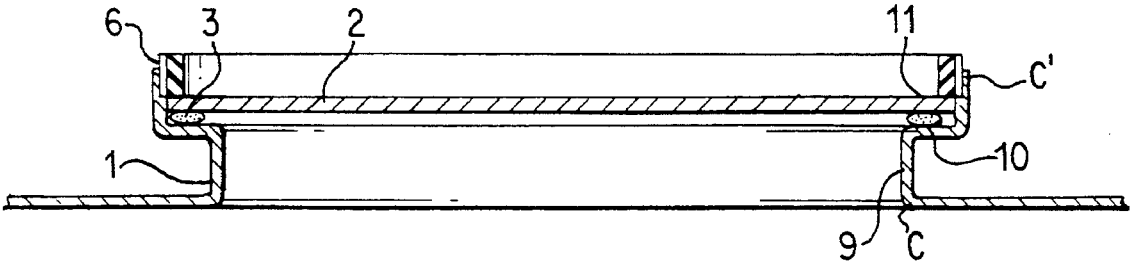

FIG. 16 depicts a preferred embodiment in which the bung stopper 2 is a simple disk. At the collar there is an inner thread into which a thread ring 6 having an outer thread is screwed. At the top side or inner side of the thread ring there may be recesses into which tools can engage in order to tighten respectively loosen the collar-stopper connection. In this preferred embodiment the collar sealing area 10 of the sealing means at the collar is about parallel to the receptacle wall 1.

Figure 17:
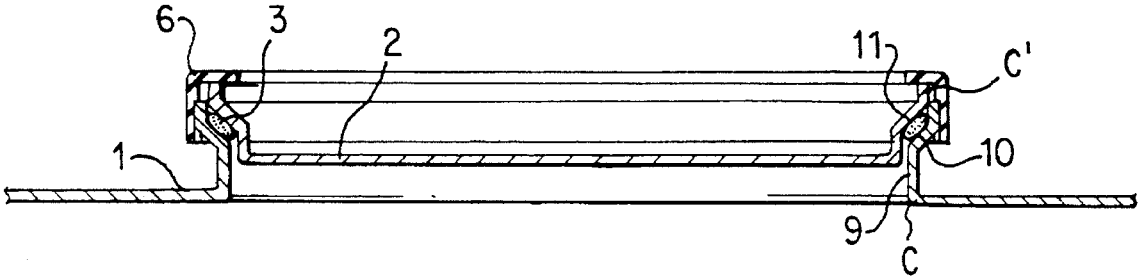

In the preferred embodiment illustrated in FIG. 17, the collar sealing area 10 of the sealing means at the collar is disposed approximately at an angle of 45° to the receptacle wall 1. Furthermore, in this preferred embodiment the thread ring has an inner thread which engages with the outer thread at the collar.

Figure 18:
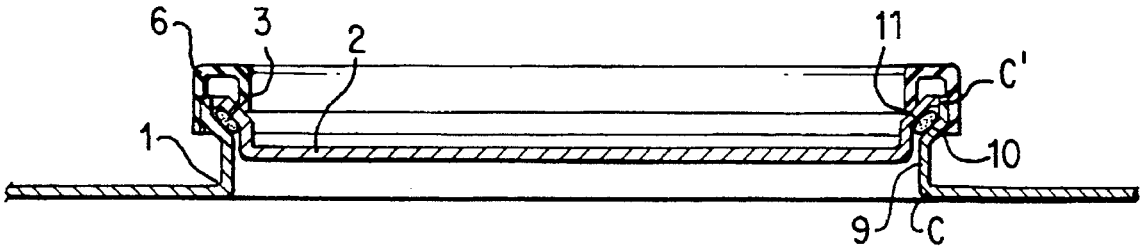

The preferred embodiment illustrated in FIG. 18 corresponds largely to the preferred embodiment according to FIG. 17.

However, due to the shape of the thread ring 6, which has an approximately U-shaped cross-section, the firmness and sturdiness of the thread ring is improved.

Figure 19:
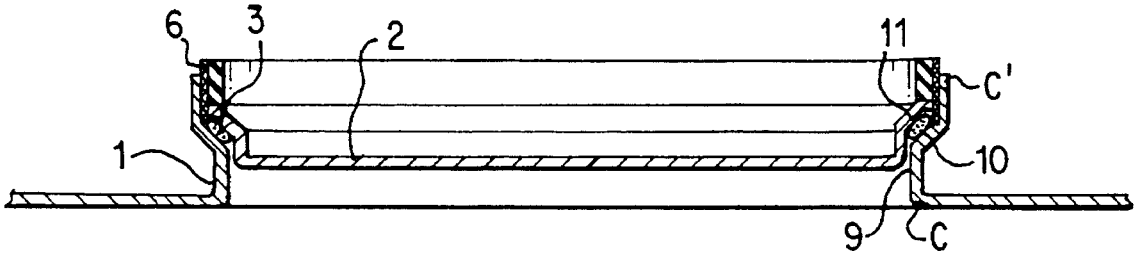

The preferred embodiment illustrated in FIG. 19, is designed similar to the preferred embodiment according to FIG. 16. However, due to the arrangement of the sealing surface at the collar at an angle of 45° to the wall of the receptacle 1, a deep-drawn stopper, having compared to the disk-shaped stopper improved sturdiness and firmness, may be utilized instead of a disk-shaped stopper.

Figure 20:
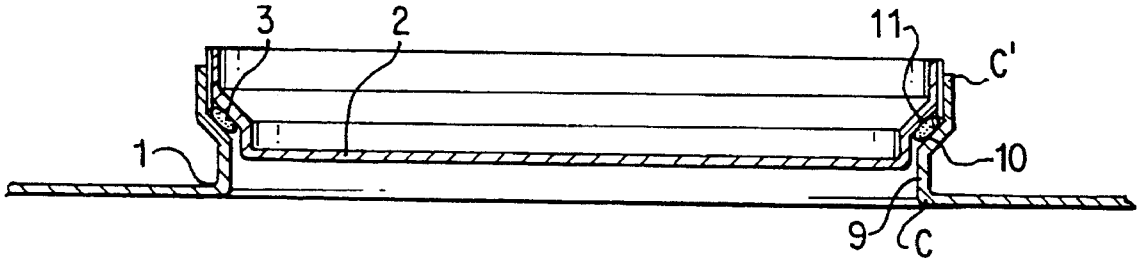
Figure 21:
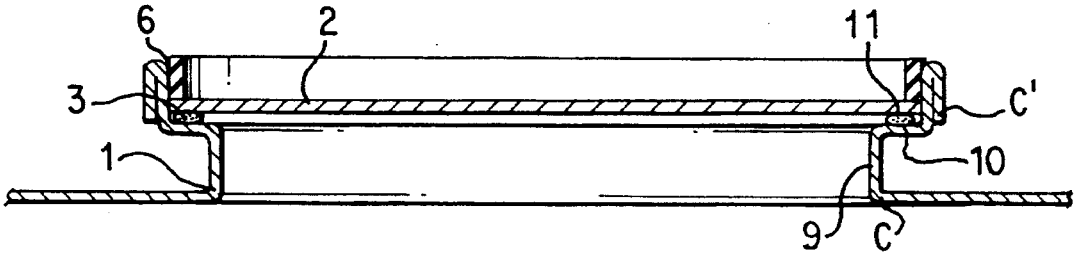
Figure 22:
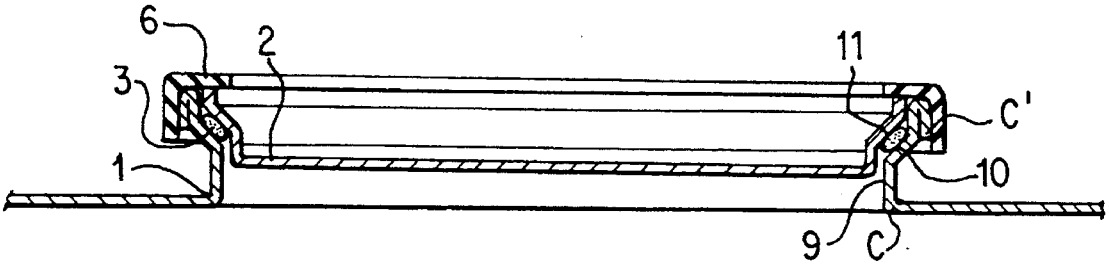
Figure 23:
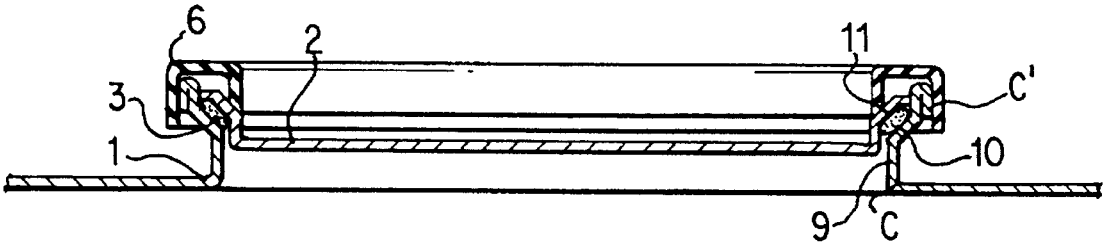
Figure 24:
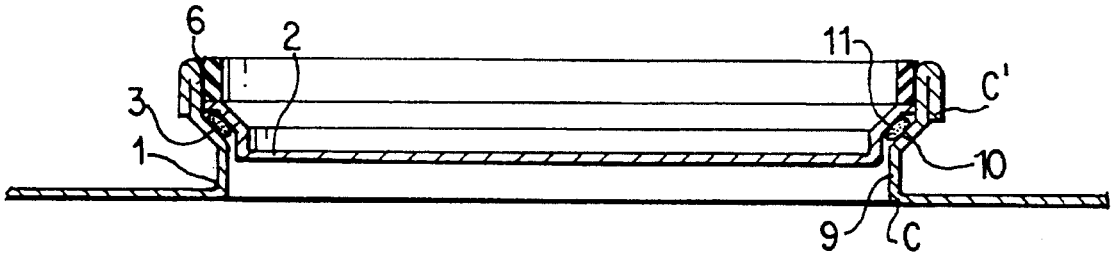
Figure 25:
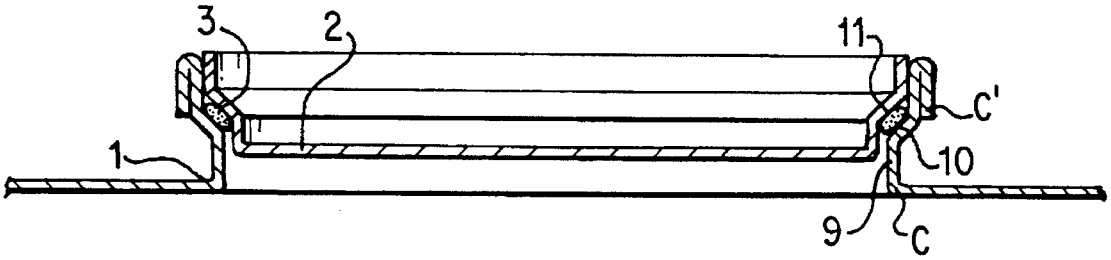

In the case of the bung receptacle illustrated in FIG. 20, the stopper 2 with the thread ring is executed in one piece; this design has advantages if the bung stopper is not "attacked" by the material stored in the bung receptacle.

The preferred embodiments illustrated in FIGS. 21 to 25 largely correspond to the preferred embodiments according to FIGS. 16 to 20. They differ, however, from them by a double wall in the thread region at the collar of the bung receptacle. Moreover, with regard to the design details reference is made to the drawing.

In the aforegoing the present invention has been described using preferred embodiments without the intention of limiting the overall scope and spirit of the inventive idea. In particular, the previously described preferred embodiments may be provided with a stiffening rim disposed under the flange or with a rim surrounding the bunghole, which protects the bunghole from damage. Alternative clamping mechanisms deviating from the U-shaped or V-shaped variants may also be utilized.

What is claimed is:

1. A receptacle having a bunghole surrounded by a collar molded out of material of the receptacle, said collar forming a collar sealing area, and a closure arrangement comprising:

a bung stopper for closing the bung hole, said bung stopper forming a bung stopper sealing area, said bung stopper being disk-shaped and without pretightening elements, a sealing element which in use with the bung stopper closing the bunghole is disposed between the collar sealing area and the bung stopper sealing area, and a clamp band separate from the bung stopper, said clamp band being engageable with said collar and being engageable with the bung stopper to compress the sealing element in a direction of said collar sealing area to sealingly close said bunghole, wherein said bung stopper is a planar disk shaped member over its entire surface.

2. A closure arrangement according to claim 1, wherein only one clamp band is provided, which one clamp band totally surrounds said bunghole.

3. A closure arrangement according to claim 1, wherein said clamp band is applied radially to the collar and bung stopper.

4. A closure arrangement according to claim 1, wherein said clamp band is applied axially to the collar and bung stopper.

5. A closure arrangement according to claim 1, wherein said clamp band is attached to the collar and bung stopper by means of folding, flanging or extrusion.

6. A closure arrangement according to claim 1, wherein said sealing element is an O-ring.

7. A closure arrangement according to claim 1, wherein a rim which surrounds said collar and the height of which is greater than that of said collar is molded out of the material of said receptacle and serves for the protection of said bunghole.

8. A closure arrangement according to claim 1, wherein said collar protrudes radially outward of the bunghole.

9. A closure arrangement according to claim 1, wherein said collar is turned outward or inward in such a manner that a double wall is obtained.

10. A closure arrangement according to claim 1, wherein said collar is bent outward and inward into a sort of "S" shape so that a double wall is formed.

11. A closure arrangement according to claim 1, wherein said sealing areas are disposed approximately parallel to a wall of said receptacle containing the bunghole.

* * * * *